United States Patent [19]

Thole

[11] Patent Number: 4,720,273

[45] Date of Patent: Jan. 19, 1988

[54] CONNECTOR ASSEMBLY FOR ANODE SOCKET OF CATHODE RAY TUBE

[76] Inventor: Thomas V. Thole, 5543 Jessup Rd., Cincinnati, Ohio 45239

[21] Appl. No.: 860,244

[22] Filed: May 6, 1986

[51] Int. Cl.[4] ..... H01R 11/22

[52] U.S. Cl. ..... 439/592; 439/825; 439/849

[58] Field of Search ..... 339/12 V, 59 R, 60 R, 339/61 R, 252 R, 252 P, 256 SP, 258 S, 258 TC; 439/592, 825, 849

[56] References Cited

U.S. PATENT DOCUMENTS

| | | | |
|---|---|---|---|
| 2,626,978 | 1/1953 | Coyle | 339/258 TC |
| 2,704,837 | 3/1955 | Wintriss | 339/252 |
| 2,882,430 | 4/1959 | Nordby | 313/64 |
| 3,258,732 | 6/1966 | Martin | 339/59 |
| 3,267,412 | 8/1966 | Rosenberg et al. | 339/223 |
| 3,412,366 | 11/1968 | Pittman | 339/60 |
| 3,431,544 | 3/1969 | Valle et al. | 339/256 |
| 3,486,162 | 12/1969 | Leitmann | 339/61 |
| 3,783,432 | 1/1974 | Biba et al. | 339/252 |
| 3,784,952 | 1/1974 | Murray | 339/59 |
| 4,155,614 | 5/1979 | Hall | 339/60 |
| 4,167,299 | 9/1979 | Noguchi | 339/59 R |
| 4,191,973 | 3/1980 | Szydlowski | 358/245 |
| 4,204,741 | 5/1980 | Hall | 339/258 TC |
| 4,326,096 | 4/1982 | Leitmann | 174/84 R |
| 4,382,650 | 5/1983 | Herrmann, Jr. | 339/60 |
| 4,418,171 | 11/1983 | Hall | 339/258 TC |
| 4,422,707 | 12/1983 | Wada et al. | 339/61 |
| 4,566,746 | 1/1986 | Hobson | 339/60 |
| 4,582,388 | 4/1986 | Swaffield | 339/258 TC |

FOREIGN PATENT DOCUMENTS

| | | | |
|---|---|---|---|
| 2034852 | 2/1972 | Fed. Rep. of Germany . | |
| 2453565 | 5/1976 | Fed. Rep. of Germany . | |
| 2507546 | 9/1976 | Fed. Rep. of Germany . | |
| 2520633 | 11/1976 | Fed. Rep. of Germany . | |
| 2814312 | 10/1978 | Fed. Rep. of Germany . | |
| 2744351 | 4/1979 | Fed. Rep. of Germany . | |
| 2747103 | 4/1979 | Fed. Rep. of Germany . | |
| 3328033 | 2/1985 | Fed. Rep. of Germany | 339/61 R |
| 7407892 | 2/1975 | Netherlands | 339/258 TC |
| 1032163 | 6/1966 | United Kingdom . | |
| 1195690 | 6/1970 | United Kingdom . | |
| 1402552 | 8/1975 | United Kingdom . | |

*Primary Examiner*—John McQuade

*Attorney, Agent, or Firm*—Wood, Herron & Evans

[57] ABSTRACT

An improved connector assembly for interconnecting the high voltage cable output of a DC power supply to the anode socket embedded in the exterior surface of a cathode ray tube envelope wall, including a terminal having an inner end mechanically connected to the cable and electrically connected to the conductive core thereof and an outer end formed as a female connector, a generally U-shaped stamped spring metal clip having a pair of uniquely configured upstanding arms for electrically and mechanically connecting to the anode socket and having a male-configured connector integral therewith which mechanically and electrically connects with the female connector of the terminal, and a resilient cup having a large cavity which encloses the outer ends of the clip arms and a small cavity which snugly embraces the lower portion of the U-shaped metal clip, including the male connector thereof, and the female connector of the terminal. The cup also has a barrel into which the terminal is inserted for connection to the clip connector and which frictionally grips the insulative sheath of the high voltage cable. A shield washer surrounds the arms at a point where they emerge from the small cavity in the cup into which the base of the clip is inserted.

36 Claims, 14 Drawing Figures

3
3
12
12a
12b
18
18a
18b
18c
18d
20
21
21a
22
24
24a
24a'
28
32
34
36
38
40
42
44
46
48
48a
50
52
52a
52a'
54
64
66
67
70a
70b
72
74
75
75a
75b
80
90
94
94e
100
102
T

CONNECTOR ASSEMBLY FOR ANODE SOCKET OF CATHODE RAY TUBE

This invention relates to electrical connectors, and more particularly to electrical connectors for interconnecting a high voltage power supply and an anode socket embedded in the exterior surface of a cathode ray tube envelope.

Cathode ray tubes, such as a television picture tubes, typically have a conductive socket embedded in the exterior surface of the evacuated glass envelope which encloses the cathode ray tube. The outer portion of the socket includes an annular ring having a circular lip which is generally flush with the exterior surface of the evacuated glass envelope. To connect high voltage to the anode socket from a suitable remote power supply, it has been the practice to utilize a dual leg U-shaped resilient metal clip which is permanently connected to the power supply via a flexible cable. The inner or bottom end of the clip, as well as a short portion of the conductor permanently connected thereto located adjacent the clip bottom, are mounted in a small, closed cavity of a resilient cup with the free ends of the legs of the clip extending through an aperture in the cup into a large, open cavity defined by a skirt section of the cup. In accordance with some known connectors, separate metal brackets are fitted into the bottom of the cavity to which the bottom of the U-shaped clip is fastened utilizing screws or the like. The free ends of the clip legs extending into the large open cavity of the resilient cup have laterally outwardly projecting tangs, barbs, or the like which, when the legs are inserted into the opening in the anode socket defined by the annular ring and released from a compressed condition necessary for insertion, seat against the interior circular edge or lip of the annular ring of the anode socket. When so connected, the outer rim of the cup seats against the exterior surface of the evacuated glass envelope exterior wall, shielding the anode clip and socket.

Ideally, an anode connector assembly, including the various elements which comprise it such as the clip and cup, should be inexpensive in terms of material cost, assembly complexity and time, and number and complexity of manufacturing steps for the connector components. In addition, the connector assembly should be easily and reliably connected to the high voltage wire from the power supply, and once so connected, should be relatively easily attached to the anode socket, and once attached should resist inadvertent disengagement. Also, the anode clip, once secured to the anode socket, should resist movement relative to the anode clip or ring which, if permitted to occur, positions the cup eccentrically with respect to the anode socket, permitting radiation emitted from the vicinity of the anode ring to escape, which radiation is normally attenuated by the cup. The anode clip should also be designed such that when inserted into the anode socket there is minimal tendency to chip the glass which surrounds it underlying the anode ring. Finally, the assembly should provide a secure and reliable mechanical and electrical connection between the anode clip and the flexible electrical conductor.

A number of prior art anode connector assemblies have been proposed in the past as illustrated by the following U.S. Pat. Nos. 2,704,837; 3,258,732; 3,267,412; 3,431,544; 3,486,162; 3,783,432; 3,784,952; 4,155,614; 4,204,741

While various anode connector proposals may have satisfied one or more of the foregoing design requirements, none of them has been altogether satisfactory. For example, some U-shaped anode clips have required utilization of a separate stamped anchor and associated screw fastener for securing the anode clip to the anchor. This increases the number of parts, requiring additional material and manufacturing steps, as well as increases the number of assembly steps as well as the difficulty of the assembly process. When one considers that anode connector assemblies are utilized by the millions each year, increased cost in terms of added material, and/or additional manufacturing and/or assembly steps, can amount to very substantial added costs in terms of absolute dollars. In addition, dimensional variances in the screw fasteners can cause loose connections, which result in the need for a 100% inspection and testing program. Similar problems can develop with the anchors due to die wear and heat treating variances.

In accordance with other anode connector assembly proposals the high voltage conductor from the power supply has been connected to the U-shaped anode clip with solder. Solder connections require defluxing and are often unreliable, and require in certain cases that the wire be pre-treated and/or pre-formed into a particular shape to facilitate soldering.

Some anode connector assemblies have utilized anode clips having multiple sharp bends or angles which create undesirable stresses and are subject to premature failure due to such causes as hydrogen embrittlement, die stress concentrations, etc. Other anode connector assemblies heretofore proposed have required resilient cups having an unnecessarily high profile. This not only adds to the cost of silicone material required for molding the cup, but also promotes undesirable movement of the cup relative to the anode socket should it be inadvertently bumped during handling of the cathode ray tube subsequent to connection of the anode clip and socket, such as may occur during assembly of the cathode ray tube into the television cabinet, testing of the television prior to final assembly, etc. A further problem with high profile cups is that the CRT, once assembled in the TV cabinet, often places the anode cup too close to the wall of the cabinet which, if metallic, can create electrical hazards.

Some of the anode connector assemblies, by reason of the particular configuration of the anode clip have had a tendency to damage the resilient cup when inserted into the cavity thereof. A similar tendency to damage the resilient cup has also been present in some of the prior anode connector assemblies having shield washers designed to minimize stray radiation. When the shield washer is mounted into a specially configured retaining recess formed in the resilient cup, it often cuts the rubber, damaging the cup.

Accordingly, it has been an objective of this invention to provide a low cost anode connector assembly which can be easily connected to an anode socket to establish a reliable electrical and mechanical connection with a minimum risk of glass chipping and relative movement once so connected. This objective has been accomplished, in accordance with certain principles of the invention, by providing a unique and unobvious U-shaped clip having a central base and oppositely disposed generally parallel arms, which is formed from a one piece stamped band of electrically conductive spring resilient sheet material. The clip includes a connecting element or tab formed integral with the base which has an outer section spaced from and disposed parallel to the base which can slidingly interact with a suitably configured terminal electrically and mechanically connected to the end of the high voltage wire for the purpose of establishing both a mechanical and electrical connection between the end of the high voltage wire and the U-shaped anode clip. In a preferred form, the connecting element of the U-shaped clip is positioned between the lower confronting portions of the arms in the region where they connect to the central base, and is generally male-configured to be gripped by a terminal attached to the end of the high voltage wire which is female-configured when the latter is slid over the connecting element of the clip. By providing one of the terminal and clip connecting element with a detent and the other of the terminal and clip connecting element with a suitably located aperture which receives the detent when the terminal and clip connecting element are engaged, disengagement of the terminal and clip connecting element can be substantially inhibited or prevented, as desired.

As a consequence of the foregoing construction, preforming of the end of the high voltage wire into a loop or the like and/or soldering operations are eliminated, reducing assembly time and expense as well as increasing the reliability of the connection between the wire and the anode clip.

In accordance with certain additional principles of the invention, the outer ends of each of the arms of the U-shaped anode clip are each provided with a necked region of substantially reduced width measured between the opposite longitudinal edges of the arms. The height of the neck measured along the length of the arm is designed to slightly exceed the thickness of the annular ring formed in the anode socket which defines the opening in which the outer free ends of the anode clip arms are inserted in the course of establishing an electrical and mechanical connection between the U-shaped anode clip and the anode socket. The portion of each arm located between the necked region and the other extremity or tip of the arm is provided with at least one locking wing which is bent laterally outwardly such that they intersect a plane containing the neck region at a substantial angle, for example, approximately 90°. In a preferred embodiment the wings are each generally triangular in shape with the innermost edges thereof being generally perpendicular to the longitudinal axis of the arm such that they underlie and seat against the inner surface of the annular anode ring, establishing both an electrical and mechanical connection between the anode clip and the anode socket. The triangular shaped wings each have a second side whereat the wing integrally connects to the outer end of the arm with respect to which it is bent at an approximately 90° angle. The remaining edge of each wing, which constitutes the hypotenuse of its triangular shape, slopes outwardly away from the outer tip or extremity of the arm. This edge of the wings, when the free ends of the arms are inserted into the anode ring, slide along the inner circular edge or lip of the annular anode ring until the neck region thereof is reached whereupon the wings snap outwardly to underlie and grip the bottom surface of the annular ring of the anode socket.

In accordance with still further principles of the invention, a shield washer is provided which is adapted to encircle the arms of the U-shaped anode clip at an intermediate point along the length thereof. To lock the shield washer in place at the desired location along the arms of the anode clip, the edge-to-edge width of the arms at the desired location of the shield washer is reduced to provide a pair of shoulders projecting from opposite edges of the arms and against which the outer surface of the shield washer seats when it is slid over the U-shaped clip from the bottom, that is, from the central base region of the clip. The shoulders, of which there are four per anode clip, stabilize the shield washer in a position approximately perpendicular to the length of the anode clip arms. The arms are also provided with a detent spaced slightly from the side of the shield washer opposite that which seats against the shoulders formed in the edge of the arms. The detents limit movement of the shield washer on the arms in a direction toward the base of the anode clip, preventing it from being slid back off of the arms of the clip over the central base. In a preferred form of the invention the shield washer-retaining detents formed in the clip arms project outwardly such that, in addition to limiting movement of the shield washer toward the base of the U-shaped clip, the detents also function to frictionally grip the interior walls of the cavity in the cup into which the clip is placed, thereby preventing inadvertent dislocation of the clip during shipping, assembly, and the like.

An important advantage of the clip of this invention attributable to the fact that except for the wings of each clip arm which are bent transverse to the overall plane of the arms, and the right angle bends where the inner end of the arm connects integrally to the central base of the U-shaped clip, the arms are free of sharp bends. Such bends tend to unduly increase the likelihood of stress failures, introduce additional steps in the manufacturing process for the clip, and require more clip material, further adding to the overall cost of the clip.

In accordance with another aspect of the invention, the female-configured terminal connected to the end of the high voltage wire is provided with an extension at its leading end which projects forwardly beyond the elements of the terminal which grip the connecting tab of the U-shaped anode clip. A suitably positioned internal recess is formed in the cavity of the resilient cup in which the terminal is inserted. The recess engages the extension on the leading edge of the terminal when it grips the connecting tab of the U-shaped anode clip. The engagement of the terminal extension with the internal cup recess inhibits rotational movement of the terminal about its longitudinal axis which, by reason of the mechanical connection between the terminal and the U-shaped clip connecting tab, also inhibits rotation of the U-shaped clip about the longitudinal axis of the terminal. The engagement of the terminal extension and internal cup recess also inhibits withdrawal of the anode clip from the cavity in the cup in which it is normally seated. The anti-rotation and anti-withdrawal characteristics imparted to the U-shaped clip by the terminal extension and internal cup recess limit disorientation of the arms of the clip relative to the cup which if permitted to occur could degrade the quality and/or reliability of the electrical and mechanical interconnection between the anode clip and the anode socket of a cathode ray tube.

In accordance with a still further aspect of the invention, the base of the U-shaped clip is rectangular and the inner sections of the arms which extend from opposite sides of the base are each both in a single plane and perpendicular to the base as well as have a width which is substantially uniform along the length thereof and conextensive with the side of the base from which the inner arm section extends. Further, the U-shaped clip has a connecting element which extends from a third side of the base between the inner arm sections, with no portion thereof extending beyond the perimeter of the base. A resilient insulative cup is provided with a skirt defining a large cavity, a central body section having a small cavity, and a barrel having a bore which connects to the small cavity. The cross-section of the small cavity is rectangular and coextensive in shape and area to that of the clip base, enabling the top interior wall of the small cavity to snugly support the entire base of a clip inserted therein and a pair of opposite side cavity walls to snugly support over their entire surfaces the inner sections of the clip arms, thereby inhibiting wabble of the clip relative to the small cavity.

By virtue of the use of the wire terminal and associated anode clip connecting tab, solder connections between the wire and anode clip, and their attendant disadvantages, are eliminated. In addition, and by reason of the unique configuration of the U-shaped arm, separate brackets and screw fasteners for securing the U-shaped arm in the cup are unnecessary, further reducing the cost of materials, manufacturing, and assembly, as well as improving the integrity and reliability of the connector assembly.

Finally, by virtue of the cooperating detent and shoulders on the arms of the anode clip the shield washer can be pre-assembled with the clip and will not become inadvertently disconnected during shipping or assembly. In addition, the detents which cooperate to locate and retain the shield washer on the arms, perform the additional purpose of gripping the walls of the cup cavity in which the U-shaped clip is placed, inhibiting inadvertent withdrawal during shipping and assembly.

These and other features, advantages, and objectives of the invention will become more readily apparent from a detailed description of a preferred embodiment thereof in which.

Figure 1:
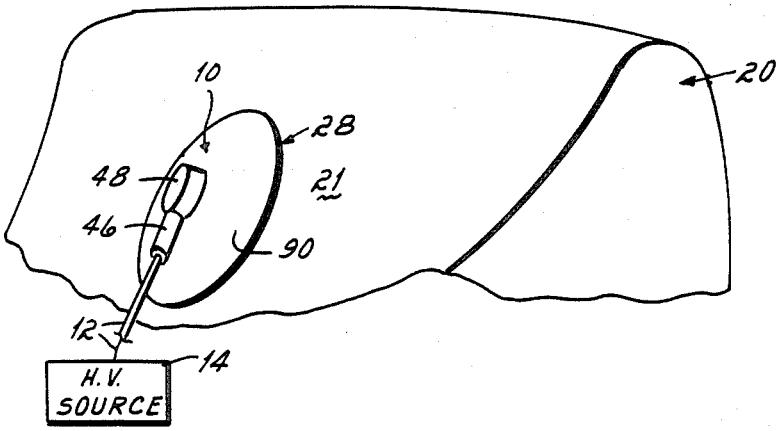
FIG. 1 is a perspective view of a cathode ray tube showing the connector assembly of this invention operatively associated therewith.

As shown in FIG. 1, the anode connector assembly 10 of this invention is designed to connect the insulated wire or cable 12 of a high voltage source 14 to the anode ring 18 (FIG. 4) of a cathode ray tube 20, such as, a television picture tube. The connector assembly 10 includes a conductive metal terminal 22 which is secured to the insulated wire or cable 12 to establish an electrical connection between the conductive core **12*a* thereof and the terminal. The anode connector assembly further includes a conductive metal anode clip 24 which is selectively connectable to both the terminal 22 and the anode socket 18 of the CRT 20. Also included in the anode connector assembly 10 is a resilient insulative cup 28 which encloses the anode clip 24 as well as the terminal 22 when it is connected to the clip and a portion of the insulated wire 12 located adjacent the terminal. When the terminal 22 is connected to the anode clip 24 and the anode clip 24 is connected to the anode socket 18, the cup 28 is slightly compressed (FIGS. 2 and 3**) to assure a tight fit between the anode socket and the clip.

The insulated wire or cable 12 includes an insulative sheath **12*b* of suitable dielectric material selected to properly insulate the conductive core 12*a* when the high voltage source 14 is energized. For a typical television tube, the conductive core 12*a* is 20 gauge A.W.G. conductive wire and the insulative sheath 12*b* is approximately 3/16 inch in diameter, and capable of withstanding temperatures up to 105° C. and voltages up to 40 K.V. d.c. A satisfactory wire 12** is commercially available from Suprenant Division, ITT, designated Style 3239 FR-1. Of course, other insulated wire or cables can be used depending on the particular application.

The terminal 22, as shown best in FIGS. 4 and 8–10, includes an elongated flat section 30. Preferably, the extreme left or inner end 32 is provided with a pair of arms **32*a* and 32*b*, which are integrally connected to the terminal section 32, are provided. The arms 32*a* and 32*b* are adapted to be bent toward each other around the insulative sheath 12*b* of the wire 12 for the purpose of frictionally gripping the sheath and establishing a mechanical connection between the terminal and cable. Extending from intermediate section 34 of the elongated flat section 30 of the terminal 22 is a second pair of arms 34*a* and 34*b* which are adapted to tightly encircle the insulation-free conductive core 12*a* of the wire 12 for establishing an electrical connection between the terminal 22 and the conductive core of the insulated wire. The dimensions of both the arms 32*a* and 32*b* and the arms 34*a* and 34*b*** are not critical, and can be suitably chosen to provide the desired frictional gripping and electrical contact characteristics.

Extending from an outer section 36 of the elongated flat section 30 are confronting arms **36*a* and 36*b* which are bent in semi-cylindrical configuration with their respective free end edges 36*a*' and 36*b*' spaced slightly from the confronting surface of the outer section 36. The spacing between the edges 36*a*' and 36*b*' and the confronting surface of the outer section 36 is designed relative to a connecting tab or element 24a formed integral with the anode clip 24, to be described in detail hereafter, such that the tab 24a is slidingly received between the clip arm ends 36a' and 36b' and the confronting surface of the outer section 36** and frictionally gripped thereby.

Extending upwardly from the outer section 36 of the terminal toward the arms edges 36a' and 36b' is a locking tab 38 formed by a punch, in a manners well known to those skilled in the art. The configuration and dimensions of the locking tab 38 are such that it engages an aperture 24a' formed in the tab 24a when the tab 24a is slidingly gripped between the outer clip section 36 and the arm edges 36a' and 36b' formed integral therewith, thereby inhibiting disengagement of the terminal 22 and the clip 24 once engaged. If disassembly of the termimal 22 and anode clip 24, once assembled, is desired, the interlocking tab 38 of the terminal and/or the aperture 24a' of the clip can be eliminated.

The right or leading end 40 of the elongated flat section 30 of clip 22 extends beyond the gripping arms 36a and 36b, terminating in a slightly rounded edge 40a. As will be described in more detail hereafter, the terminal end 40 seats in a suitably configured and positioned internal recess 42 of the insulative cup 28 (FIG. 2) located opposite the internal end of a bore 44 of an egress barrel 46 extending from a button-shaped central body section 48 of the cup into which the terminal 22 and the adjacent portion of the wire 12 are inserted when it is desired to electrically and mechanically connect the terminal to the clip 24 which seats in a small cavity in the cup.

To facilitate easy insertion of the connecting tab or element 24a of the anode clip 24 in between the arm edges 36a' and 36b' and the confronting surface of the outer section 36 of the terminal 22, bevels 36a'' and 36b'' are formed at the right hand corners of the gripping arm edges 36a' and 36b' respectively.

The anode clip 24, as shown best in FIGS. 2, 3, 4, 11, 12, and 13, comprises a one-piece stamping of electrically conductive spring sheet material which is formed into a generally U-shape having a central base 50 of generally rectangular shape and identical oppositely disposed, generally parallel elongated arms 52 and 54 which are integral with, and symmetrically disposed relative to, the central base 50. Since the arms 52 and 54 are identical, only arm 52 will be described in detail.

More particularly, arm 52 includes an outer section 56, an intermediate section 58, and an inner section 60 which are integral with each other and with the central base 50. The inner section 60 is generally rectangular and includes an outwardly projecting punched tab or detent 52a for reasons to become apparent hereafter. The width of the inner section 60 is slightly less than that of the intermediate section 58, providing retention means or shoulders 64 and 66 on the outer edges 106 and 108 of arms 52. The edge 52a' of detent 52 and the shoulders 64, 66 cooperate to retain a shield washer 67 in the approximate relative position along arm 52 shown in FIG. 2 when the shield washer 67 encircles the inner end sections 60 of the arms 52 and 54 between the detent end 52a' and the shoulders 64, 66. Thus, the detent 52a and the shoulders 64, 66 formed on each of the arms 52 and 54 function as retention means to retain the shield washer 67 in encircling relationship to the clip arms 52 and 54 at the approximate position along the length of the arms 52 and 54 shown in FIGS. 2 and 3. The shoulders 64, 66 on arms 52, 54 maintain the shield washer 67 approximately perpendicular to the arms.

The outer section 56 of the arms 52 and 54 include a reduced width or necked region 70 and a wing-bearing section 72. The height H of the necked region 70 measured along the length of the arm 52, for reasons to be become apparent hereafter, is slightly larger than the thickness T of the anode socket ring lip 18a, as best seen with reference to FIG. 2–4. The wing-bearing section 72 of the outer arms section 56 includes a pair of wings 74 and 75 which extend outwardly in a generally perpendicular direction to the plane of the intermediate section 58. The wings 74 and 75 are identical to each other in shape and dimension and each include edges 74a and 75a which are generally perpendicular to the plane of the intermediate section 58, and an angled edge 74b and 75b which are inclined outwardly from the extremity of the outer arm section 56. The edges 74a, 74b, 75a, and 75b of the wings 74 and 75, when the clip 24 is engaged with the anode socket 18, underlie the lower surface 18b of the anode socket ring lip 18a. Due to the resilient nature of the cup 28, and as will become more apparent hereafter, the wing edges 74a and 75a and are biased upwardly against the overlying surface 18b of the anode socket ring lip 18a when the anode clip 24 is engaged with the anode socket 18. Under such conditions, substantially the entirety of edges 74a and 75a are in electircal contact with the overlying lower surface 18b of the anode lip 18a, as best seen in FIG. 3.

Figures 2, 3:
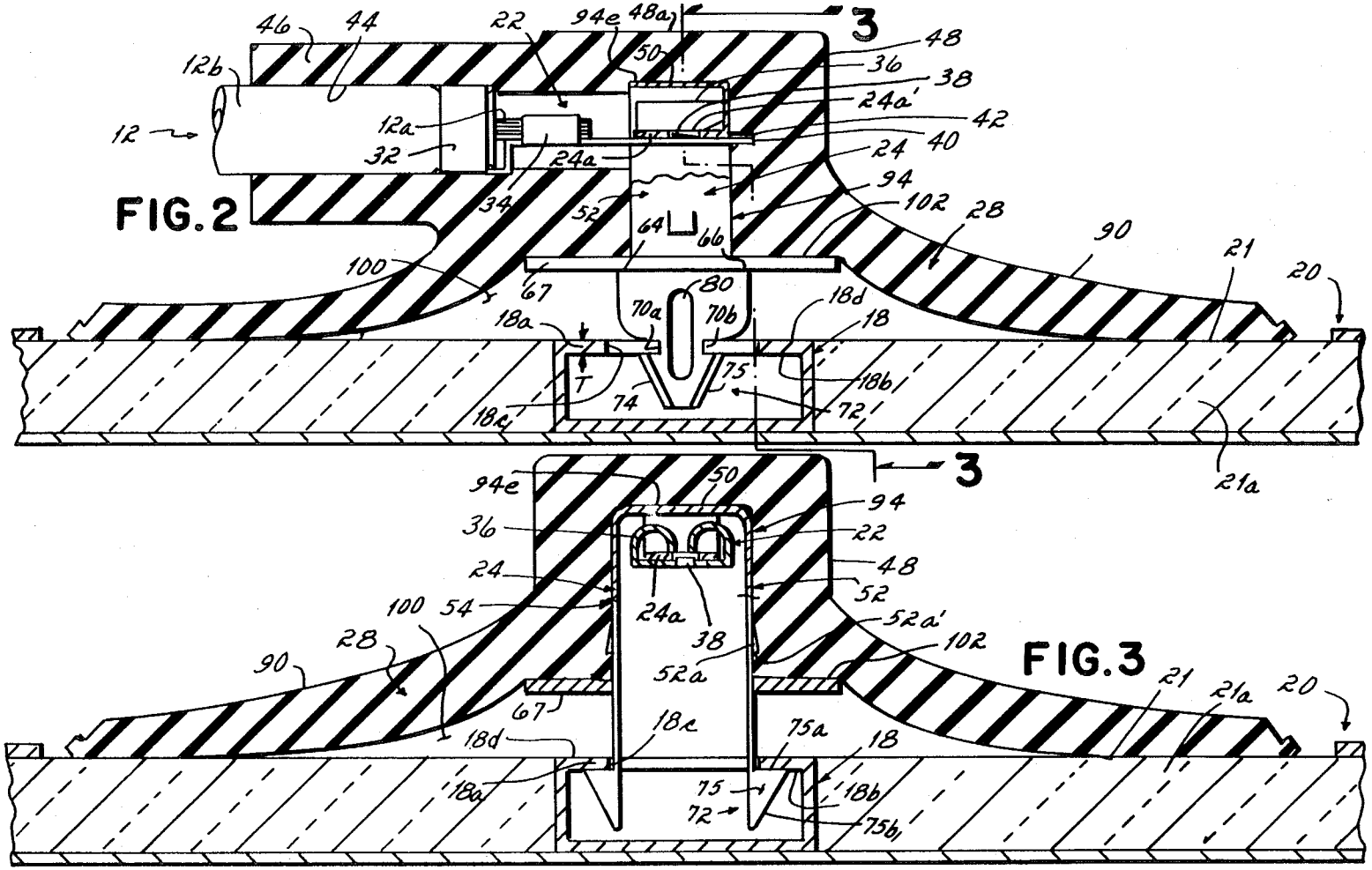
FIG. 2 is a vertical elevational view through the center of the connector assembly and the cathode ray tube anode socket, depicting the relationship of the insulating cup, high voltage insulated wire terminal, anode clip, shield washer, and anode socket when the connector assembly is operatively connected to a cathode ray tube anode socket.
FIG. 3 is a cross sectional view along line 3—3 of FIG. 2.
Figure 5:
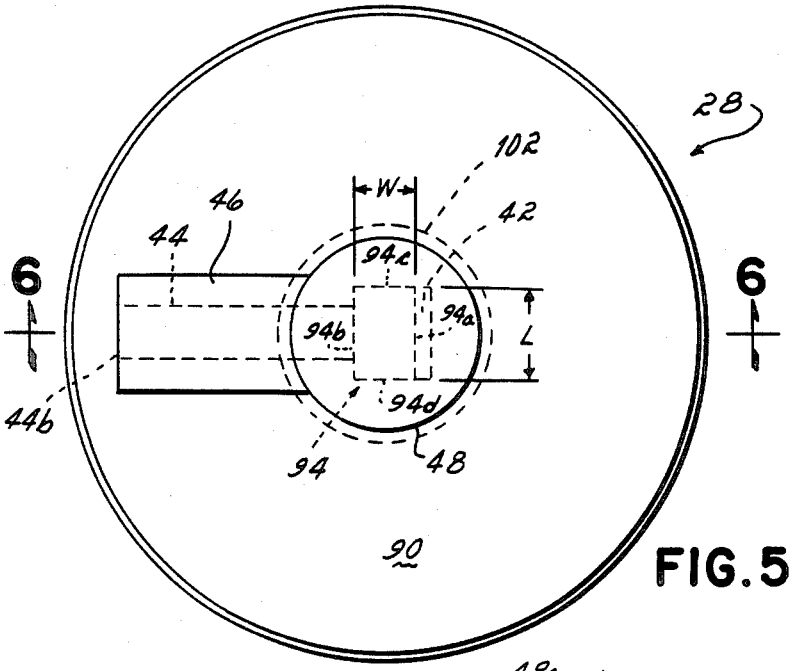
FIG. 5 is a top view of the insulative cup.
Figure 11:
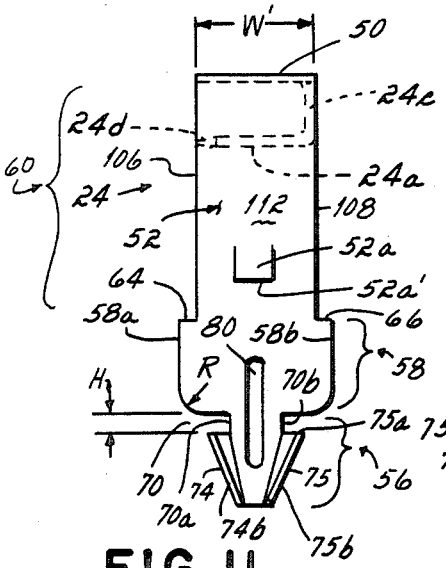
FIG. 11 is a front elevational view of the anode clip.

The wing edges 74b and 75b of the wings 74 and 75 slidingly engage the edge 18c of the anode ring lip 18a when the wing-bearing portion 72 of the arms 52 and 54 are inserted into the anode socket 18, camming the wing-bearing portions 72 of the arms 52 and 54 inwardly as required to enable the wings 74 and 75 to seat beneath the lip 18a of the anode socket 18 as shown best in FIGS. 2 and 3. In their normal unstressed position shown in FIG. 4 and 12, the outer extremities of arm sections 56 and necked regions 70 are spaced apart a distance greater than the diameter of the edge 18c of the anode ring lip 18a. The wings 74 and 75 are also angled inwardly that is, toward each other in the direction of their outer extremities, as best shown in FIG. 11. The angulation of the wing edges 74b and 75b in combination with the angulation of the wings 74 and 75 with respect to each other provide the cooperating wing pairs 74, 75 with an overall tapered configuration to enhance the ease of insertion of the wing-bearing section 72 of each of the arms 52, 54 into operative engagement in the anode socket 18.

To strengthen the intermediate section 58 and the outer section 56 of the arms 52, 54, particularly in the region of the neck 70, an elongated rib 80 can be formed in the arms 52 and 54 by conventional techniques well known in the art. It is preferable that the rib 80 extend inwardly so that it will not increase the distance between the outer surface of the neck region 70 and the edge 18c of the anode socket 18 when the clip 24 is engaged with the anode socket.

The intermediate section 58 has parallel edges 58a and 58b which extend generally longitudinally in the direction of the length of the arms 52 and 54. At their inner ends the edges 58a and 58b terminate at the shoulders 64 and 66, respectively. At their lower ends the edges 58a and 58b are provided with a substantial radius R such that the generally vertical edges 58a and 58b smoothly curve to become horizontal where they intersect with the vertical edges 70a and 70b of the neck 70.

When the anode clip is operatively engaged in the anode socket 18, as shown in FIGS. 2 and 3, the outer (lower as viewed in FIGS. 2 and 3) inwardly curving portions of edges 58*a* and 58*b* seat against the upper surface 18*d* of the anode socket lip 18*a* while the edges 74*a* and 75*a* of the wing 74 and 75 seat against the lower surface 18*b* of the anode lip 18*a* with the outer surface of the neck 70 biased against the edge 18*c* of the anode lip 18*a*. Due to the slight curvature of the anode lip edge 18*c*, the outer surface of the neck 70 actually contacts the anode lip edge 18*c* only along the vertical edge portions 70*a* and 70*b* of the neck 70.

As previously noted, to enable mechanical and electrical interconnection of the terminal 22 and the anode clip 24, the clip is provided with a connecting element or tab 24*a* having an aperture 24*a*'. The tab 24*a*, which is positioned between sections 60 of arms 52, 54, is disposed generally parallel to the central base 50 to which it is integrally connected by a clip section 24*c* disposed generally perpendicular to the central base 50 and the apertured tab 24*a*. To facilitate entry of the connecting tab 24*a* between the ends 36*a*' and 36*b*40 of the gripping arms 36*a* and 36*b* of the terminal 22 and the confronting surface of the intermediate terminal section 36, the edge 24*d* disposed opposite tab section 24*c* is chisel-shaped.

Figure 4:
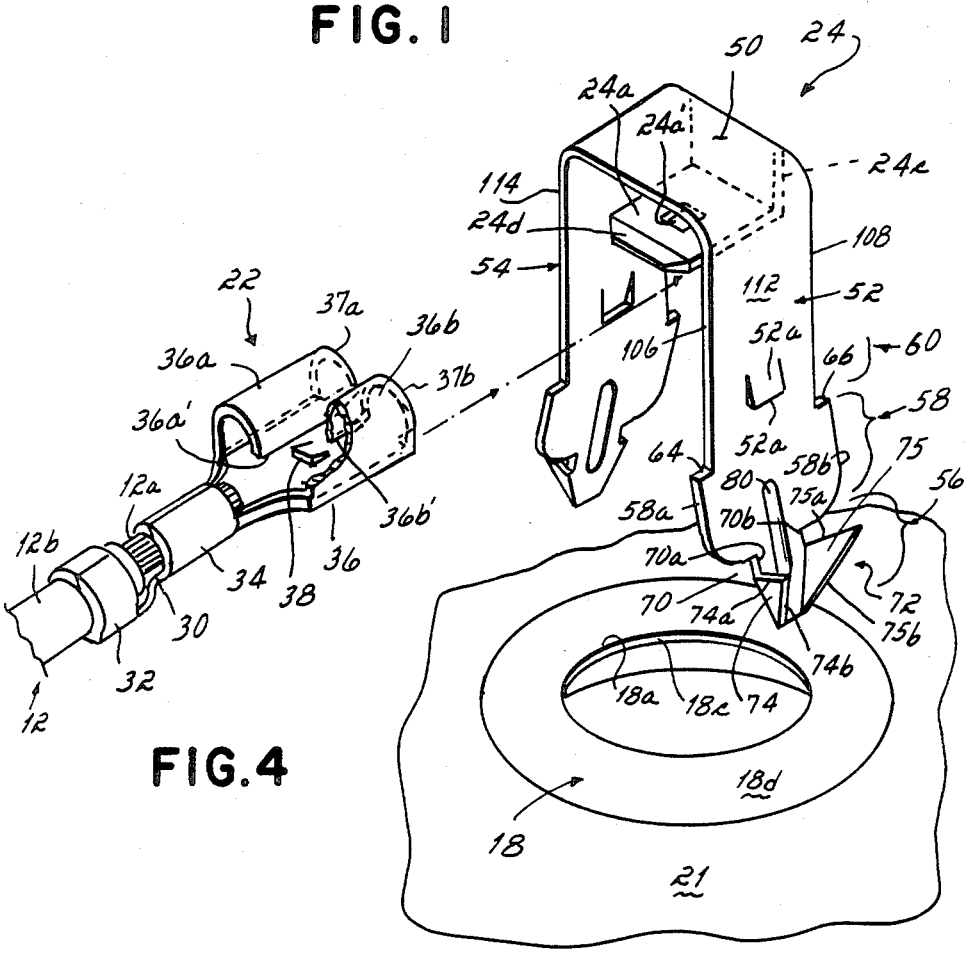
FIG. 4 is an exploded perspective view of the high voltage insulated wire terminal, anode clip (without the cup), and anode socket prior to engagement of the insulated wire terminal and anode clip and prior to engagement of the anode clip and anode socket.
Figure 12:
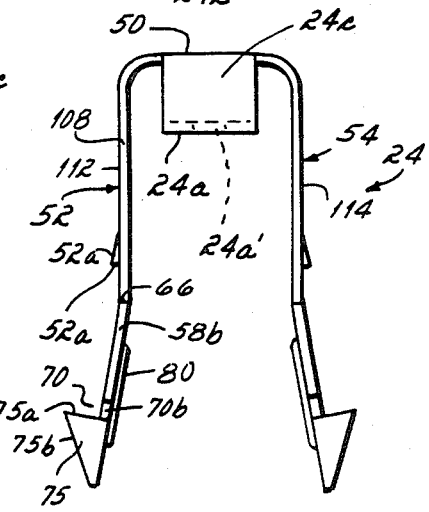
FIG. 12 is an elevational view of the left side of the anode clip in in its relaxed, unrestrained position.
Figure 14:
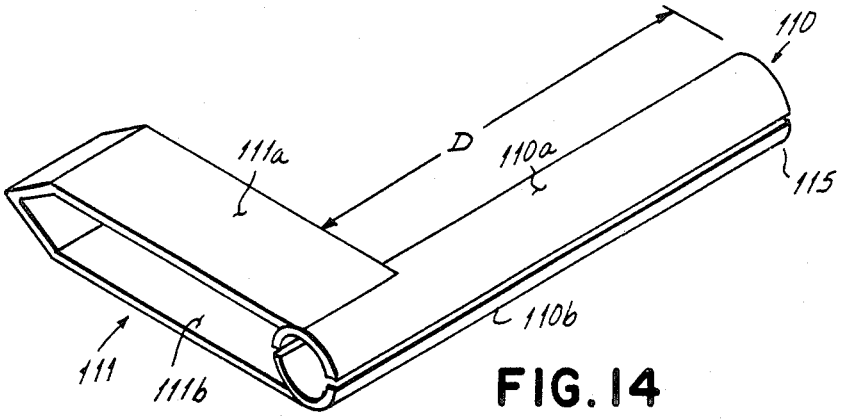
FIG. 14 is a perspective view of one preferred form of tool useful for enlarging the bore of the cup egress barrel to facilitate damage-free insertion of the terminal into the cup for engagement with the anode clip.

As apparent from FIGS. 4 and 12 the intermediate section 58 and outer section 56 of the arms 52 and 54 are angled outwardly relative to the inner section 60 of the arms. This angulation insures that the neck 70 of each of the arms 52 and 54 will be urged outwardly against the anode lip edge 18*c* when the clip 24 is operatively engaged with the anode socket 18. As best seen in FIG. 3, this angulation of the arms sections 56 and 58 largely disappears when the outer sections 56 of the arms 52 and 54 are captured in the anode socket 18.

Figure 6:
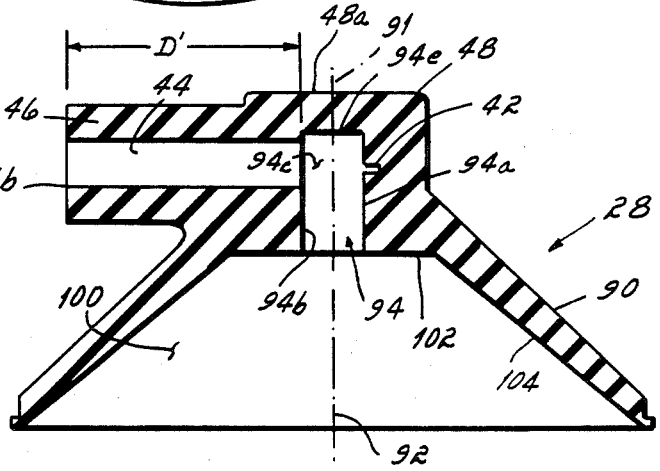
FIG. 6 is a cross sectional view along lines 6—6 of FIG. 5.
Figure 7:
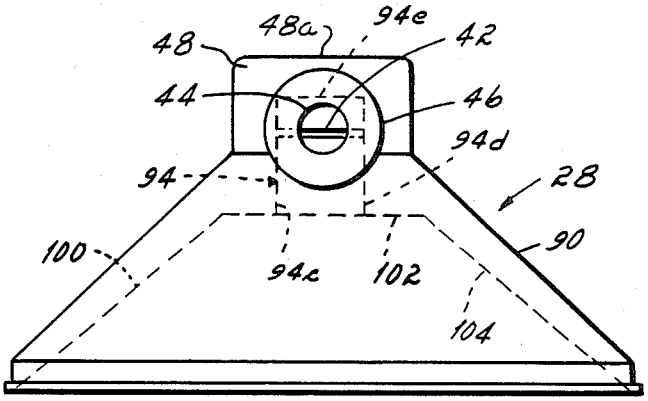
FIG. 7 is an elevational view of the left side of the insulative cup.
Figure 10:
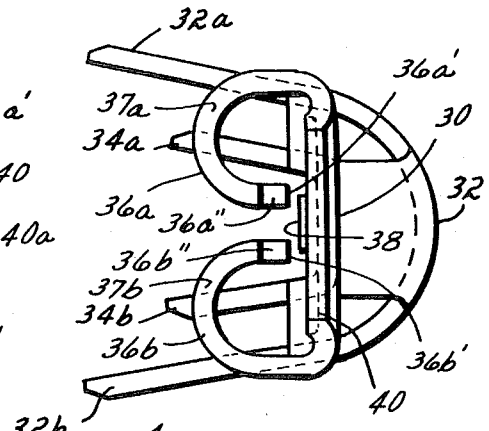
FIG. 10 is an elevational view of the right side of the anode clip.
Figure 9:
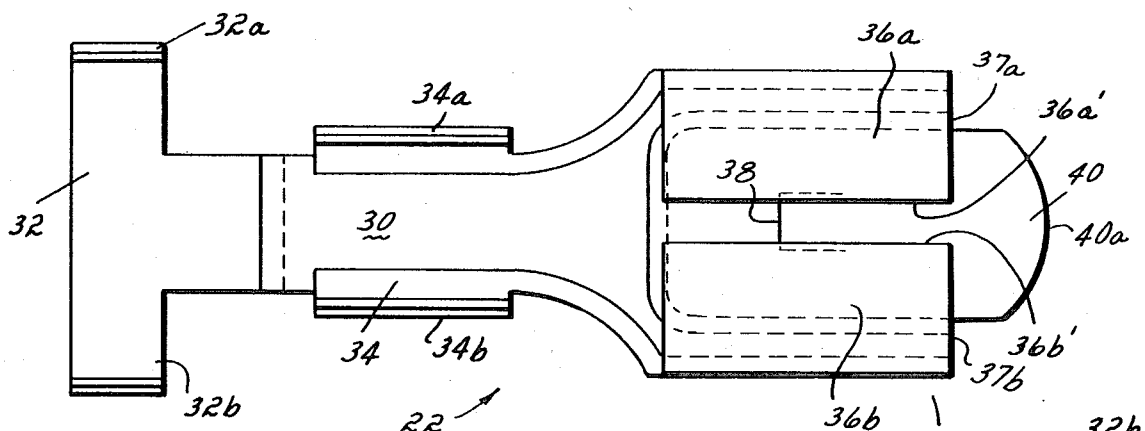
FIG. 9 is a top view of the anode clip.
Figure 8:
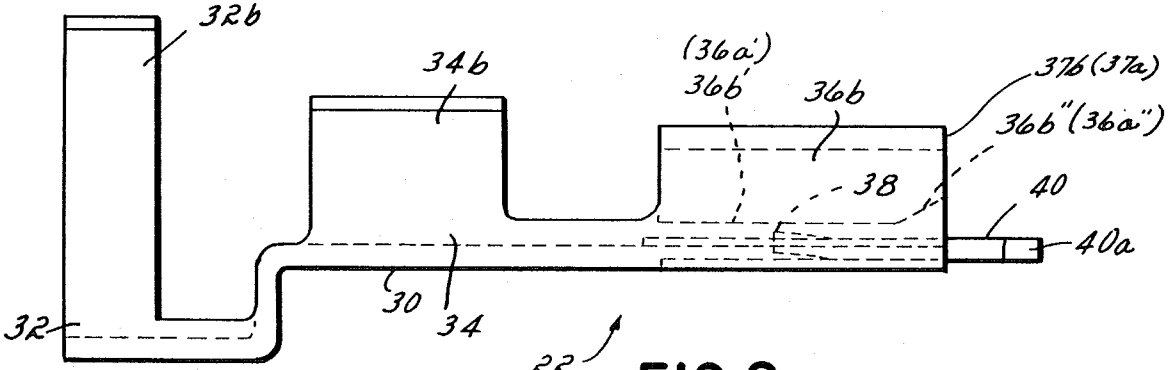
FIG. 8 is a front view of the anode clip showing the orientation of the various elements thereof prior to connection with the bared end of the high voltage insulated wire.
Figure 13:
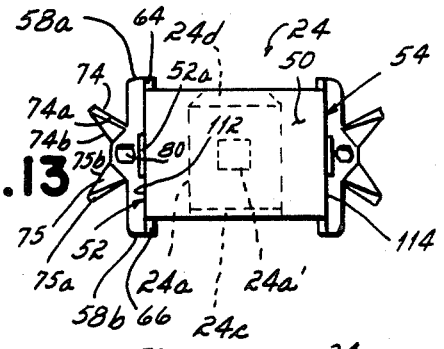
FIG. 13 is a top plan view of the clip shown in FIGS. 11 and 12.

The insulative cup 28, as best shown in FIGS. 2, 3, and 5–7, includes the button-shaped central body 48 which has a generally cylindrical overall shape, a tubular egress barrel 46 which extends perpendicular to the vertical axis 91 of the cylinder-shaped cup body 48, and a generally frusto-conically shaped, flared skirt section 90 having a vertical axis 92 which is coincident with the vertical axis 91 of the central body 48. The insulative cover 28 is preferably injection molded of resilient dielectric material, such as that available from General Electric Company designated GE5559-U which is a silicone rubber having the desired dielectric properties suitable for high voltage operation. With the cup 28 being fabricated by injection molding, the body 48, barrel 46 and skirt 90 are integral with each other. Located within the egress barrel 46 is the bore 44. The internal diameter of the bore 44 in its unstretched condition shown in FIG. 6 is selected to be slightly less than the outside diameter of the dielectric sheath 12*b* of the high voltage wire 12 such that when the terminal 22 is located in the bore 44 and connected with the clip 24, the barrel 46 will frictionally grip the insulative sheath 12*b* of the wire 12.

Located within the body 48 of the cup 28 is a cavity 94 having a generally rectangular cross section of uniform size throughout its vertical extent. The cavity 94 is disposed generally symetrically with respect to the vertical axis 91 of the cup body 48. Approximate its upper end, the cavity 94 connects to the inner end of the bore 44 as appears best in FIG. 6. At its lower end the cavity 94 connects with the generally frusto-conically shaped cavity 100 defined by the annular upper surface 102 and frusto-conical surface 104 of the skirt 90. The slot or recess 42, which receives the leading end 40 of the outer section 36 of terminal 22 when fully inserted into the bore 44, is formed in the wall 94*a* disposed opposite the innermost end of the bore 44. The recess 42 in combination with the terminal end 40 which is located therein when the terminal is inserted in the bore 44 for electrical and mechanical interconnection with the clip 24, maintains the desired distance between the outer clip section 36 and the wall 102, preventing the clip 24 from being dislocated in a vertically downwardly direction as viewed in FIGS. 2 and 6 relative to the cavity 94. The engagement of the recess 42 and terminal end 40 also limits rotation of the terminal 22 in the bore 44 about its longitudinal axis. Stated differently, the engagement of the terminal end 40 and cup recess 42 promotes perpendicularity between the clip arms 52 and 54 relative to cavity axes 91 and 92.

The cross sectional width W of the cavity 94 is selected such that cavity walls 94*a* and 94*b* snugly grip the parallel vertical edges 106 and 108 of the inner arm sections 60 of clip arms 52 and 54 when the clip 24 is fully inserted in cavity 94 with clip section 50 seated against cavity end wall 94*e*. Thus, the cross sectional width W of the cavity 94 defined by confronting walls 94*a* and 94*b* is substantially equal to the width W' of inner sections 60 of arms 52 and 54. The cross sectional length L of the cavity 94 defined by confronting parallel cavity walls 94*c*, 94*d* is designed such that the outer surfaces 112 and 114 of the inner sections 60 of arms 52 and 54 are snugly gripped by cavity wall surfaces 94*c* and 94*d* when the clip is inserted fully into the cavity 94 as shown in FIGS. 2 and 3.

The location of the locking tabs 52*a* extending outwardly from the inner arm sections 60 of arm 52 and 54, and the shoulders 64 and 66, in addition to being selected to maintain the shield washer 67 therebetween, are also selected relative to the location of the central base 50 such that when the clip 24 is fully inserted into the cavity 94 with the base 50 in contact with the top surface 94*e* of the cavity 94, the upper surface of the shield washer 67 will be in intimate physical contact with the annular surface 102 defining the top of the frusto-conical cavity 98. Due to the construction of the anode connector assembly, the shield washer 67 is retained in contact with annular surface 102 without resort to molding a lip or the like on the interior surface 104 of the skirt 90 to encircle and encase the perimeter of the shield washer, as is necessary with some assemblies heretofore proposed.

Assembly of the anode connector of this invention is preferably accomplished by first inserting the inner section 60 of the clip arms 52, 54 into the circular opening of the shield washer 67. Insertion of the arm sections 60 of the clip 24 into the central opening in the shielding washer 67 continues past the outwardly projecting detents 52 until the shielding washer rests against the shoulders 64 and 66 of each of the arms 52, 54, at which point the lower edge 52*a*' of the detents 52*a* will extend outwardly above the upper surface of the shield washer. In the process of fully inserting the clip arms sections 60 into the central opening of the shield washer 67, it is necessary to exert slight inward pressure on the arms 52 and 54 so that the washer can slide over the outwardly projecting detents 52*a* formed in the inner arm sections 60 of the arms 52 and 54.

With the shield washer on the arm sections 60 of arms 52 and 54 captured between the detent edge 52*a* and the shoulder 64, 66, the assembled shield washer and clip are then inserted into the cavity 94 of the cup 28 with the end 24d of the connecting tab 24a located adjacent the cavity wall 94b and the tab extension 24c located adjacent the cavity wall 94a. Insertion of the inner arm sections 60 of the clip arms 52 and 54 continues until the central base 50 contacts the top surface 94e of the cavity. When fully inserted the connecting tab 24a will be positioned very slightly above the recess 42 (FIG. 2) such that when the connecting tab 24a is engaged between terminal grouping edges 36a', 36b' and the confronting surface of terminal section 36, the terminal end 40 will be aligned with and insertable into the recess 42 as best shown in FIG. 2. Thus, the vertical height of the tab section 24c should be approximately equal to the vertical distance between the recess 42 and the cavity surface 94e. When the clip arms 52 and 54 are fully inserted into the cavity 94, the upper surface of the shielding washer 67 will be in intimate physical contact with the annular surface 102 of the cavity 100, as noted previously. Clip detents 52a on arms 52, 54, which are spaced slightly above the washer 67, frictionally grip cavity walls 94c and 94d, inhibiting removal of the clip from the cavity.

As is apparent from the foregoing discussion, and after inserting the clip 24 into the cavity 94, the terminal 22 is inserted into the bore 44 of the barrel 46 to mechanically and electrically connect the connecting tab 24a between the gripping edges 36a' and 36b' and the confronting surface of outer terminal section 36, as seen best in FIGS. 2 and 3. When the terminal 22 is fully inserted, the terminal locking tab 38 will be seated in the aperture 24a' in clip connecting element or tab 24a, preventing withdrawal of the terminal relative to the clip, and the leading end 40 of the terminal 22 will be seated in the recess 42 to prevent twisting of the terminal 36 about its longitudinal axis and/or vertical shifting movement of the outer terminal section 36, and in turn arms 52, 54, relative to the longitudinal axis of the cavity 94. With the terminal fully inserted a substantial portion of the exterior surface of the insulative sheath 12b of the insulated wire 12 is frictionally gripped by the barrel bore 44, as shown in FIG. 2.

The leading edges 37a and 37b of the female gripping arms 36a and 36b, when the terminal is fully inserted, abut the clip tab section 24c, preventing the leading edge 40a of the terminal 22 from being inserted too far into the recess 42 in the cup, which if permitted to occur could damage the cup.

To prevent damage to the interior of the barrel bore 44, particularly at the entrance end 44b thereof when the leading end 40 of the terminal is initially inserted, the edge 40a of the terminal end 40 is slightly rounded, as previously described. To further minimize the possibility of damage to the bore 44 of the barrel 46 upon insertion of the terminal 22, it is preferable to enlarge or dilate the bore 44 prior to and during insertion of the terminal 22 into the barrel 46. Such enlargement of the barrel can be accomplished, in a preferred form, by inserting a tube 110 split longitudinally into separate equal section 110a and 110b. The split tubular sections 110a and 110b are held in alignment by a U-shaped spring clip 111 which has its opposite ends 111a and 111b permanently fastened to tubular sections 110a and 110b respectively, adjacent one end thereof. The distance D measured longitudinally between the other end 115 of the split tube 110 and the point at where the U-shaped spring connector 111 is secured to the tubular sections 110a and 110b is selected to slightly exceed the length D' (FIG. 2) of the bore 44 of barrel 46. The outside diameter of the split tubular sections 110a and 110b when urged toward and into contact with each other along their confronting longitudinal edges is such that the split tube can be inserted easily into the barrel bore 44 along the entire length thereof to located split cylinder sections 110a and 110b for the length D thereof in the bore 44 of barrel 46.

With the split cylinder sections 110a and 110b inserted into the bore 44 of barrel 46 for distance D, the arms of the U-shaped clip 111 are then spread apart by suitable means (not shown) to separate the split cylinders 110a and 110b and thereby enlarge the bore 44. When the split cylinder separation has been accomplished to a degree sufficient to enable the terminal 22 to be readily inserted into the interior of the spaced-apart split cylinder sections 110a and 110b, the terminal is inserted into bore 44 and mechanically and electrically engaged with the clip 24 as previously described. Once the terminal 22 has been inserted into the clip 24 and engaged therewith, the split tube 110 is slid out of the bore 44 of barrel 46 whereupon the bore 44 tightly frictionally grips the exterior surface of the insulative sheath 12b inserted therein.

To engage the anode clip with the anode socket of a fully assembly anode connector assembly as shown best in FIGS. 2 and 3, the skirt 90 of the cup 28 is temporarily bent upwardly to more fully expose the downwardly extending intermediate section 58 and outer section 56 of the anode clip arms 52 and 54. The lowermost extremity of the wing-bearing section 72 of one of the arms 52 and 54 is inserted into the opening in the anode socket 18 and against the lip edge 18c thereof. When so inserted, the anode connector assembly is urged toward the anode lip section which is in contact with the inserted clip arm to deflect the inserted arm toward the noninserted arm, thereby reducing the distance between the arms. This action is continued until the distance between the arms is reduced sufficiently to permit the noninserted arm to be inserted into the anode socket 18, whereupon the connector assembly is urged toward the socket to introduce the heretofore noninserted arm into the socket. Downward motion of the anode connector assembly relative to the anode socket 18 continues until the neck 70 of the arms 52 and 54 is opposite the lip edge 18a whereupon the anode lip 18a is gripped between the upper edges 74a and 75a of the wing 74 and 75 and the innermost and lowermost horizontal portions of the edges 58a and 58b of the intermediate section 58 of the arm 52 and 54. With this accomplished the skirt 90 is allowed to return toward its normal position to the extent permitted by the exterior wall surface 21 of the cathode ray tube wall 21a in which the anode socket 18 is mounted with its upper lip surface 18d flush with CRT surface 21 as best shown in FIGS. 2 and 3. With the anode clip 24 and the anode socket 18 engaged as shown in FIGS. 2 and 3, the skirt 90 of the cup 28 is resiliently deformed, urging the anode clip upwardly relative to the anode socket 18, inhibiting mechanical disengagement therebetween as well as establishing a good electrical connection therebetween and a tight seal between the outer rim portion of surface 104 of the skirt 90 and the CRT outer surface 21.

The connector assembly of this invention, particularly the cup 28, has a relatively low profile. With reference to FIGS. 2 and 3, the thickness of the cup body section between cavity surface 94e and cup body exterior surface 48a is seen to be uniform. This is in contrast to conical shapes sometimes found in prior cup structures which have undesirably higher profiles which can be inadvertently bumped during TV set assembly and test, thereby degrading the mechanical and electrical characteristics of the connection between the anode clip and the anode socket.

In the preferred embodiment, the outer terminal section 36 is configured as a female connector element and the anode clip tab 24*a* as a male connector element. If desired, these could be reversed, with the terminal configured as a male connector and the anode clip as a female connector. In addition, the arms 32*a* and 32*b* of the terminal which grip the insulative sheath 12*a* of the cable 12 could, if desired, be eliminated if mechanical interconnection therebetween is unnecessary.

In a preferred form, the anode clip is fabricated of 0.015 SAE 1074 and 1050 sheet steel to which is added tin plate to a plating thickness of 0.00005.

In additional to the foregoing, several additional aspects of the connection assembly merit mention. The outer connecting element section 24*a* which slidingly connects with outer terminal section 36 is parallel to and spaced from base 50 such that when the outer terminal section and outer connecting element section are engaged, the terminal is not mechanically engaged by either the base or the inner arm sections 60. Further, when the terminal outer section 36 and connecting element outer section 24*a* are electrically and mechanically engaged, neither the core 12*a* or the insulative sheath 12*b* are in direct mechanical contact with the anode clip arms 52, 54 or the base 50. Stated differently, the sheath 12*b* and/or core 12*a* of the cable 12 are neither directly gripped by the anode clip arms 52, 54 and/or the base 50 nor is the core 12*a* directly electrically connected to the base or arms. Thus, connection of the terminal 22 to the clip 24 can be done without altering the shape of the clip or deflecting its arms.

Another feature of note is that the inner arm sections 60, except for detents 52*a* and the connecting element sections 24*a* and 24*c* do not extend beyond the perimeter of the base 50, enabling the cross-sectional area of the small cavity 94 to be coextensive with the area of the base 50, which in turn permits the clip base 50 and arm sections 60 to be snugly gripped by the walls of the cavity 94 to thereby stabilize the clip against wobble when inserted into the cavity.

While the invention has been described in connection with a preferred embodiment, those skilled in the art will recognize that a number of modifications can be made without departing from the spirit and scope of the invention, as defined in the following claims:

I claim:

1. An anode connector assembly connectable between (a) an electrically conductive anode socket having an annular ring with an inwardly-directed circular lip mounted to the exterior wall of an evacuated glass tube, and (b) the end of an insulated high voltage wire having an electrically conductive core surrounded by an insulative sheath, said assembly comprising:

a stamped band of electrically conductive spring sheet material formed into a generally U-shaped anode clip having a central base, a connecting element, and oppositely disposed elongated arms, said arms each including (a) a first section at the free end thereof, and (b) a second section located between and integral with a side of said base and said first section, said first sections of said arms each having means for mechanically and electrically connecting said arms to said anode socket at opposite points of said lip of said annular ring, an electrically insulative resilient cup having (a) a skirt section defining a large open cavity designed to surround said first clip arm sections, (b) a central body section having a small cavity with internal walls connecting to said open cavity designed to snugly embrace said clip base and said second arm sections when said anode clip is inserted therein, said small cavity having a longitudinal axis parallel to the direction of the length of said arms, (c) a barrel having a bore therein connected at its inner end to said small cavity proximate the connecting element of an anode clip fully inserted into said small cavity, said bore further having an outer end, and a longitudinal axis which is approximately perpendicular to the longitudinal axis of said small cavity, and a conductive terminal having an inner section electrically connectable to said conductive core, said terminal having an outer section terminating at a leading edge, said terminal outer section being slidably electrically and mechanically interconnectable with said anode clip connecting element when said outer terminal section in inserted into the outer end of said barrel bore toward and into engagement with said anode clip connecting element, said terminal when engaged with said anode clip connecting element being electrically and mechanically interconnected to said anode clip only via mechanical and electrical connective engagement with said anode clip connecting element, said conductive core and said insulative sheath being free of direct mechanical engagement by said anode clip arms, anode clip connecting element and/or central base when said terminal outer section is mechanically interconnected with said anode clip connecting element.

2. The assembly of claim 1 wherein said arms and connecting element are integral with said anode clip base to provide a solder-free and fastener-free connection therebetween.

3. The assembly of claim 1 wherein said connecting element includes an outer section disposed generally parallel to said longitudinal axis of said barrel when said clip is fully inserted into said small cavity in said central body section, said electrical and mechanical interconnection between said connection element and said outer terminal section being accomplished by sliding said outer terminal section within said bore parallel to said bore axis and to said outer section of said connecting element, said terminal outer section being spaced from said central base and arms of said anode clip when connected to said outer section of said connecting element.

4. The assembly of claim 3 wherein said connecting element outer section is located between said anode clip arms and spaced from said base to position said outer terminal section between and spaced from said arms when said outer terminal section and connecting element outer section are connected.

5. The assembly of claim 4 wherein said connecting element outer section is male-configured and said outer terminal section is female-configured.

6. The assembly of claim 5 wherein said connecting element further includes an inner section integral with, and angled relative to, both said connecting element outer section and said anode clip base, said connecting element inner section configured to limit the sliding movement of said female-configured outer terminal section when engaged with said male-configured outer section of said connecting element.

7. The assembly of claim 1 further including lock means formed integral with said terminal outer section and anode clip connecting element for preventing inadvertent disengagement of said terminal outer section and said anode clip connecting element when interconnected.

8. The assembly of claim 1 wherein each of said elongated arms has (a) a pair of elongated opposite edges, and (b) a necked region of reduced edge-to-edge width located between said first and second sections, said second section of said arms having approximately uniform edge-to-edge width along a substantial portion of the length thereof and lying in substantially a single plane, and said first section of said arms having at least one locking wing bent outwardly and transversely relative to said second section.

9. The assembly of claim 8 wherein said wing includes an edge disposed substantially perpendicularly to the direction of the length of said second section, and wherein said opposite edges of a portion of said second section adjacent said necked region are disposed approximately perpendicularly to the direction of the length of said second section to lock, in combination with said perpendicular wing edge, the lip of an anode ring located therebetween when said first section of said arms are inserted into an anode socket to position said necked region proximate the anode ring lip.

10. The assembly of claim 9 wherein said wing further includes a cam edge angled outwardly from the extremity of said first section which is engageable with said anode ring lip when said first sections of said arms are initially inserted into said anode socket, to cam said first arm sections toward each other as said arms advance into said socket to enable the necked region thereof to become positioned proximate said anode ring.

11. The assembly of claim 8 further including an apertured shield washer having opposite annular surfaces and wherein said second section of said arms collectively include first and second retention means spaced from each other in the direction of the length of said second sections of said arms for retaining said washer at a specified location along the length thereof.

12. The assembly of claim 11 wherein said first retention means includes a shoulder formed in at least one of said opposite edges of at least one of said arms and wherein said second retention means includes a resilient tab formed in said at least one arm which elastically deflects when said shield washer is placed over said clip arms and advanced from said central base toward and into contact with said shoulder.

13. The assembly of claim 12 wherein said resilient tab extends outwardly from said at least one arm to frictionally grip one of said internal walls of said small cavity when said anode clip is located therein to inhibit removal of said anode clip from said small cavity.

14. The assembly of claim 12 wherein said first retention means includes shoulders formed on opposite edges of both said arms, said shoulders being located in a single plane generally perpendicular to the said arms to stabilize said shield washer in a plane generally perpendicular to said arms.

15. The assembly of claim 1 wherein said central body section of said cup has a generally cylindrical exterior shape with a substantially flat exterior top surface, and wherein said small cavity has a top internal surface and a pair of opposite internal side wall surfaces against which said central base and second arm sections of said anode clip seat, respectively, when said anode clip is fully inserted in said small cavity, the thickness of said central body section between said top internal cavity surface and said top exterior surface does not substantially exceed the thickness of said body section between said internal side walls and said generally cylindrical exterior surface, thereby providing said cup with a low profile external appearance.

16. The assembly of claim 8 wherein said central body section of said cup has a generally cylindrical exterior shape with a substantially flat exterior top surface, and wherein said small cavity has a top internal surface against which said central base of said anode clip seats when fully inserted therein, the thickness of said central body section between said top internal cavity surface and said top exterior surface is substantially uniform, thereby providing said cup with a low profile external appearance.

17. The assembly of claim 1 further including motion inhibit means located within said small cavity and cooperable with said terminal outer section, when said terminal outer section is connected to said anode clip connecting element positioned within said small cavity, for inhibiting rotation of said terminal outer section about an axis generally parallel to said axis of said bore.

18. The assembly of claim 1 further including motion inhibit means located within said small cavity and cooperable with said terminal outer section, when said terminal outer section is connected to said anode clip connecting element positioned within said small cavity, for inhibiting movement of said terminal outer section in a direction along the length of the arms of an anode clip inserted into said small cavity.

19. The assembly of claim 18 wherein said motion inhibit means also inhibits rotation of said terminal outer section about an axis generally parallel to said longitudinal axis of said bore.

20. The assembly of claim 19 wherein said motion inhibit means includes a recess in the wall of said small cavity located opposite said inner end of said bore for snugly receiving the leading edge of said outer section of said terminal when fully inserted into said bore.

21. An anode clip connectable between (a) an electrically conductive anode socket having an annular ring with an inwardly directed circular lip mounted to the exterior wall of an evacuated glass tube, and (b) the outer section of a terminal having an inner section electrically connected to the conductive core of a, when the outer terminal section is inserted into the outer end of a bore of a barrel extending from an insulative cup, which cup has a small cavity connected to the inner end of the bore in which said anode clip is locatable, said anode clip comprising:

a stamped band of electrically conductive spring sheet material formed into a generally U-shaped anode clip having a central base, a connecting element, disposed generally parallel to said central base and spaced therefrom, and oppositely disposed elongated arms angled generally perpendicular to said base and connecting element, said arms each including (a) a pair of opposite elongated edges, (b) a first section at the free end thereof, (c) a second section connected to the base, and (d) a necked region of reduced edge-to-edge width located between said first and second sections.

said second section of said arms having approximately uniform edge-to-edge width along a substantial portion of the length thereof and lying in substantially a single plane, the edge-to-edge width of said base of said U-shaped anode clip measured in a direction parallel to the edge-to-edge width of said second sections of said arms not substantially exceeding said arm width, and said first section of said arms having at least one locking wing bent outwardly and transversely relative to said second section.

22. The anode clip of claim 21 wherein said wing includes an edge disposed substantially perpendicularly to the direction of the length of said second section, and wherein said opposite edges of a portion of said second section adjacent said necked region are disposed approximatey perpendicularly to the direction of the length of said second section to lock, in combination with said perpendicular wing edge, the lip of an anode ring located therebetween when said first section of said arms are inserted into an anode socket to position said necked region proximate said anode ring lip.

23. The anode clip of claim 22 wherein said wing further includes a cam edge angled outwardly from the extremity of said first section which is engageable with said anode ring lip when said first sections of said arms are initially inserted into said anode socket, to cam said first arm sections toward each other as said arms advance into said socket to enable the necked region thereof to become positioned proximate said anode ring.

24. The anode clip of claim 21 further including an apertured shield washer having opposite annular surfaces and wherein said second section of said arms collectively include first and second retention means spaced from each other in the direction of the length of said second sections of said arms for retaining said washer at a specified location along the length thereof.

25. The anode clip of claim 24 wherein said first retention means includes a shoulder formed in at least one of said opposite edges of at least one of said arms and wherein said second retention means includes a resilient tab formed in said at least one arm which elastically deflects when said shield washer is placed over said clip arms and advanced from said central base toward and into contact with said shoulder.

26. The anode clip of claim 25 wherein said resilient tab extends outwardly from said at least one arm to frictionally grip one of said internal walls of said small cavity when said anode clip is located therein to inhibit removal of said anode clip from said small cavity.

27. The anode clip of claim 24 wherein said first retention means includes shoulders formed on opposite edges of both said arms, said shoulders being located in a single plane generally perpendicular to the said arms to stabilize said shield washer in a plane generally perpendicular to said arms.

28. The anode clip of claim 21 wherein said connecting element is integral with said base and includes an outer section located between said anode clip arms and spaced from said base to position said outer terminal section between and spaced from said arms when said outer terminal section and connecting element outer section are connected.

29. The anode clip of claim 28 wherein said connecting element outer section is male-configured to slidingly engage a female-configured outer terminal section.

30. The anode clip of claim 29 wherein said connecting element further includes an inner section integral with, and angled relative to, both said connecting element outer section and said anode clip base, said connecting element inner section configured to limit the sliding movement of said female-configured outer terminal section when engaged with said male-configured outer section of said connecting element.

31. The anode clip of claim 21 wherein said central base is free of apertures therein.

32. The anode clip of claim 31 wherein an inner section of said connecting element is angled at approximately 90° to said central base to further strengthen said base against flexure.

33. The anode clip of claim 21 wherein said second arm sections and said connecting element do not extend beyond the perimeter of said base.

34. The connector assembly of claim 1 wherein said small cavity of said central body section has a top internal surface and a pair of opposite internal side wall surfaces disposed generally perpendicular to said top surface, wherein said second arm sections and said connecting element do not extend beyond the perimeter of said base, and wherein said small cavity has a cross-sectional shape and area which is substantially uniform and coextensive with that of said base, enabling said base and second arm sections to be snugly gripped by said internal cavity top and opposite side wall surfaces to inhibit wobble of said clip when inserted into said small cavity.

35. A connector assembly connectable between (a) an electrically conductive anode socket having an annular ring with an inwardly-directed circular lip mounted to the exterior wall of an evacuated glass tube, and (b) the outer section of a conductive terminal having a leading edge at one end and being connected to the conductive core of a high voltage insulated cable at the other end, said connector assembly comprising:

an electrically insulative molded cup having (a) a skirt section defining a large open cavity;

(b) a central body section having a small cavity defined by a first and second pair of opposed internal parallel side walls and a rectangular top internal wall, the crosssection of said small cavity being coextensive in size and shape with that of said rectangular top internal wall, said small cavity having a longitudinal axis perpendicular to said top wall;

(c) a barrel having a bore therein connected at its inner end to said small cavity via one of said walls of said first pair and having an outer open end, said barrel having a longitudinal axis substantially perpendicular to said longitudinal axis of said small cavity, and (d) a recess in the other of said internal side walls of said first pair located opposite said inner end of said bore, a stamped band of electrically conductive spring sheet material formed into a generally U-shaped anode clip having (a) a central rectangular base coextensive in size and shape with said internal top wall of said small cavity, said base having a rectangular perimeter defined by four sides, (b) oppositely disposed, spaced-apart, elongated arms extending from opposite sides of said base, said arms each having (i) a first section at the free end thereof which includes means for mechanically and electrically connecting said arms to an anode socket at opposite points of annular ring thereof, (ii) a second section located between and integral with said first section and said opposite sides of said base, said second sections each being in a single plane disposed parallel to each other and perpendicular to said base, and a connecting element extending from and integral with a third side of said base located between said opposite sides of said base from which said arms extend, said connecting element having an outer section disposed between said second arm sections and substantially parallel to said base, said connecting element being free of edges which project beyond the perimeter of said base, said clip being located in said small cavity with said base in substantially full surface contact with said top internal wall, said opposite side walls of said second pair in substantially full surface contact with said second arm sections, said third side of said base being proximate said other of said walls of said first pair, said outer section of said connecting element being disposed between said inner end of said bore and said recess, and said first arm sections extending into said large open cavity, whereby the leading edge of a terminal inserted into said bore to slidingly engage said outer section of said connecting element will seat in said recess to prevent withdrawal and inhibit wobbles of said clip relative to said small cavity.

36. An electrically insulative molded cup comprising:

(a) a skirt section defining a large open cavity;

(b) a central body section having a small cavity defined by a first and second pair of opposed internal parallel side walls and a rectangular top internal wall, the cross-section of said cavity being coextensive in size and shape with that of said rectangular top internal wall, said small cavity having a longitudinal axis perpendicular to said top wall;

(c) a barrel having a bore therein connected at its inner end to said small cavity via one of said walls of said first pair and having an outer open end, said barrel having a longitudinal axis substantially perpendicular to said longitudinal axis of said small cavity, and (d) a recess in the other of said internal side walls of said first pair located opposite said inner end of said bore.

* * * * *

UNITED STATES PATENT AND TRADEMARK OFFICE

CERTIFICATE OF CORRECTION

PATENT NO. : 4,720,273

DATED : January 19, 1988

INVENTOR(S) : Thomas V. Thole

It is certified that error appears in the above-identified patent and that said Letters Patent is hereby corrected as shown below:

Column 9, line 22, "36b40" should be -- 36b' --.

Column 16, line 57, after "a" insert -- wire --.

Column 17, lines 23 and 24, "approximatey" should be -- approximately --.

Signed and Sealed this

Twenty-eighth Day of February, 1989

*Attest:*

DONALD J. QUIGG

*Attesting Officer*

*Commissioner of Patents and Trademarks*